United States Patent [19]

Schutte et al.

[11] Patent Number: 5,006,283

[45] Date of Patent: Apr. 9, 1991

[54] MIXING SYSTEM FOR DISPERSING A COMPRESSIBLE FLUID SUCH AS GAS INTO LIQUID IN A VESSEL

[75] Inventors: Marlin D. Schutte, Rochester; Craig B. Bahr, Brockport; Ronald J. Weetman; Richard A. Howk, both of Rochester, all of N.Y.

[73] Assignee: General Signal Corporation, Rochester, N.Y.

[21] Appl. No.: 254,507

[22] Filed: Oct. 6, 1988

[51] Int. Cl.[5] ..... B91F 3/04

[52] U.S. Cl. ..... 261/93; 261/123

[58] Field of Search ..... 261/93, 123, 114.2

[56] References Cited

U.S. PATENT DOCUMENTS

| | | | |
|---|---|---|---|
| 374,346 | 12/1887 | Coates | 261/123 |
| 1,441,560 | 1/1923 | Connors | 261/123 |
| 1,674,464 | 6/1928 | Burke | 261/114.2 |
| 1,776,032 | 9/1930 | Kobernik | 261/114.2 |
| 1,935,709 | 11/1933 | Hall | 261/114.2 |
| 2,070,067 | 2/1937 | Rice | 261/114.2 |
| 2,338,446 | 1/1944 | Lambert | 261/114.2 |
| 2,521,396 | 9/1950 | Moul | 261/93 |
| 3,424,443 | 1/1969 | Thayer | 261/123 |
| 3,536,305 | 10/1970 | Letrancols | 261/93 |
| 3,606,985 | 9/1971 | Reed | 261/123 |
| 3,802,674 | 4/1974 | Hori | 261/93 |
| 3,814,396 | 6/1974 | Gregorio et al. | 261/93 |
| 4,066,722 | 1/1978 | Pietruszewski et al. | 261/93 |
| 4,070,423 | 1/1978 | Pierce | 261/123 |
| 4,527,904 | 7/1985 | Weetman | 366/348 |
| 4,660,989 | 4/1987 | Davis | 261/93 |
| 4,759,910 | 7/1988 | Streiff et al. | 261/123 |

FOREIGN PATENT DOCUMENTS

| | | | |
|---|---|---|---|
| 193111 | 2/1923 | United Kingdom | 261/123 |

OTHER PUBLICATIONS

Parker et al., Turbine Mixers in Metallurgical Applications, Mining Engineering, Mar. 1956, pp. 288–292, 209–169.

American Heritage Dictionary, Cpr. 1982, p. 1231, 2nd College Ed.

*Primary Examiner*—Tim Miles

*Attorney, Agent, or Firm*—Martin Lukacher; Milton E. Kleinman

[57] ABSTRACT

The gas outlet of a pipe or other sparging device is encompassed by a cover or cap which is located between the gas outlet and the mixing impeller at the bottom of a vessel. The cap is closed at the top and has a side wall so that the gas bubbles disperse around the lower rim of the wall. The wall may be non-symmetric, such as square in cross section, so as to be at different radial positions with respect to the gas outlet. The gas bubbles, even if released in pulses are distributed spatially and in time. The lower rim is preferable serrated (as a saw tooth edge) with the teeth being of different height, thereby further spreading the distribution of the bubbles as they are dispersed. The overlap or distance between the rim and the gas outlet is such that a sufficient quantity of gas is confined around the outlet to damp pressure pulsations when the pressure of the gas at the outlet does not significantly exceed the hydrostatic pressure at the outlet into the liquid. It is believed that the cap defines an acoustic filter which damps and effectively reduces pressure pulses. A turning cone below the top of the cover and facing the outlet may be used to facilitate more uniform distribution of the gas bubbles.

8 Claims, 3 Drawing Sheets

MIXING SYSTEM FOR DISPERSING A COMPRESSIBLE FLUID SUCH AS GAS INTO LIQUID IN A VESSEL

DESCRIPTION

The present invention relates to mixing systems for dispersing a fluid into a liquid (by which is also meant a liquid suspension or slurry). The invention is particularly adapted for use in systems for sparging oxygen containing gas, such as air, into liquid in a vessel.

In a typical sparging system, pressurized air is released and dispersed into the liquid in a vessel with the aid of a mixing impeller. The sparge may be a pipe or ring. So long as the pressure of the air (back pressure) significantly exceeds the hydrostatic pressure of the liquid in the tank, a constant flow of air leaves the outlet of the sparge and is dispersed into the liquid. Under conditions where the pressure of the air does not significantly exceed the hydrostatic pressure, pulsing conditions arise, and the gas leaves the sparge outlet in pulses. These pulses create a non-uniform flow field which may result in fluid forces, especially in the axial direction, acting on the impeller which may adversely affect the operation thereof. Fluid forces in mixing systems and means for measurement thereof are described in U.S. Pat. No. 4,527,904 issued to R. J. Weetman on July 9, 1985. It is desirable, for power conservation and therefore almost always, sparging systems are operated at low back pressure.

It has been discovered, in accordance with the invention, that such pulsing conditions can be suppressed and effectively removed by surrounding the gas outlet with a cap or cover which confines a volume of gas around the outlet and below the outlet. The flow of gas is from the outlet to side walls of the cap. The gas leaves under the lower rim of the cap. This lower rim may be serrated (with a saw tooth edge) to facilitate the gas distribution. It is believed that the confined volume of gas defines an acoustic filter which damps the pressure pulsations thereby effectively eliminating pulsing conditions. The axial fluid forces are believed to arise from the release of the gas in pulses. As a result of a fluid dynamic phenomena, the pulses fluidically amplify hydraulic pressure variations thereby providing varying axial fluid forces under the impeller which can be severe enough to cause the impeller and/or the bearings and other impeller shaft support means to fail.

In addition or alternatively to supressing pulsing conditions, the distribution of the gas can be changed by providing the cap with a non-symmetric shape with respect to the gas outlet. The serrations may also vary in height. Thus the gas distribution from each pulse is spread both spatially and in time. The force field in the vicinity of the impeller then becomes more uniform and the fluid forces on the impeller are attenuated.

Caps have heretofore been used in connection with sparge outlets. Such caps have served not to confine a volume of gas in the tank around the outlet, but rather merely for the purpose of directing or distributing the flow of the gas. For example ducts or shrouds have been used (see U.S. Pat. No. 3,536,305 issued Oct. 27, 1970). Also cones have been rotated with impellers with outlets from the walls of the cones above the sparge outlet in order to distribute the flow of gas (see U.S. Pat. No. 4,066,722 issued Jan. 3, 1978). Reference may be had to U.S. patent application Ser. No. 209,158 filed June 20, 1988 in the name of R. J. Weetman for "Mass Transfer Mixing System Especially for Gas Dispersion in Liquids or Liquid Suspensions" for further information concerning gas dispersion and sparging systems. The Weetman application is assigned to the same assignee as this application.

Accordingly, it is the principal object of the present invention to provide improved apparatus for dispersing a compressible fluid, such as a gas into liquid in a vessel which substantially reduces pressure pulsing conditions.

It is another object of the invention to provide an improved gas sparging mixing system wherein pressure pulses are effectively damped.

It is a further object of the present invention to provide an improved gas sparging and mixing system which both distributes gas at the bottom of a mixing vessel and reduces pressure pulsing conditions.

It is a still further object of the present invention to provide an improved gas sparging mixing system which has a cap over the sparge outlet wherein there is sufficient spacing between the outlet and the cap to avoid fouling due to scale build up on the cap or the sparge outlet, and which substantially reduces back pressure pulsing conditions.

It is a further object of the present invention to provide an improved gas sparging-mixing system which reduces fluid forces, especially axially, acting upon the mixer impeller. Fluid forces may be axial (along the axis of the shaft) or perpendicular to the shaft axis.

It is a further object of the present invention to provide an improved gas sparging mixer system which operates at low back pressure which reduces the power required to deliver gas flow to the sparge sysem.

The foregoing and other objects features and advantages of the invention as well as presently preferred embodiments thereof will become more apparent from a reading of the following description in connection with the accompanying drawings in which.

Figure 1:
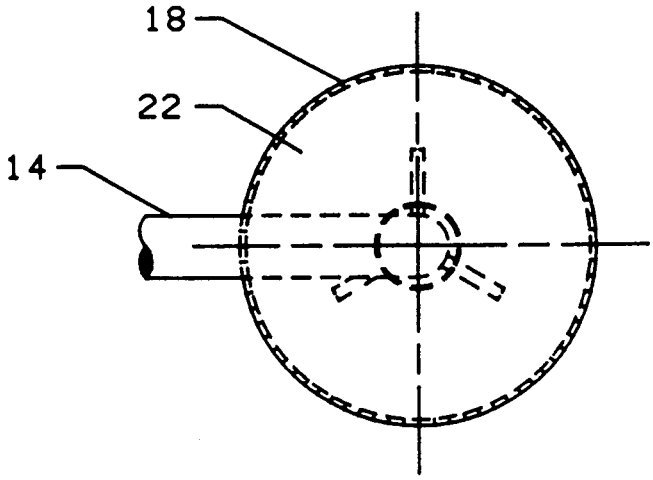
FIG. 1 is a view of sparging apparatus in accordance with the invention taken along the line A—A in FIG. 2.
Figure 3:
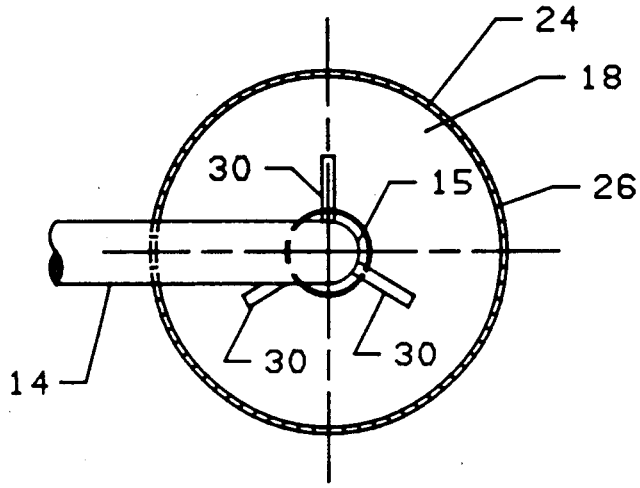
FIG. 3 is a view taken along the line B—B in FIG. 2 of the sparging apparatus shown in FIG. 2.
Figure 2:
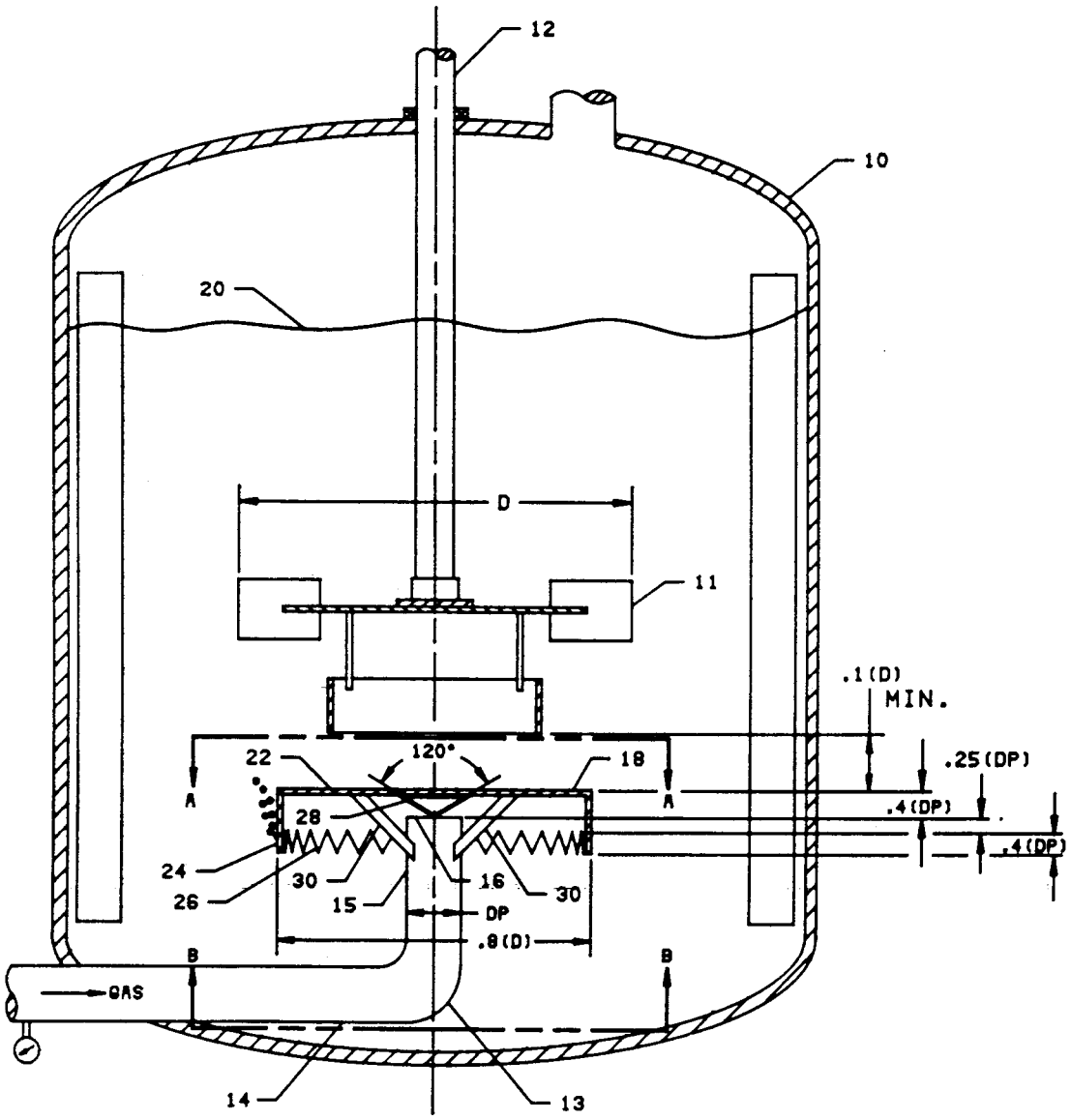
FIG. 2 is a sectional view of a mixing impeller and vessel in which the mixing system including the improved sparging apparatus according to the invention is disposed.

Referring more particularly to FIGS. 1-3 of the drawings, there is shown a vessel or tank 10 containing a mixing impeller 11 on a shaft 12 which is driven by a motor through suitable gearing; the motor and gearing not being shown so as to simplify the illustration. Baffles, a stabilizing ring, and vent of conventional design are shown in FIG. 2. The vessel 10 is shown as being closed except for the vent and opening for a sparge 13. The sparge 13 is shown in the form of a pipe having a lateral 14 and vertical 15 conduit. The vertical conduit 15 is disposed below the impeller and may be aligned with the axis of rotation of the impeller (the shaft axis shown by the vertical line made up of long and short dashes). Compressed gas, preferably air from a compressor, flows through the lateral 14 and then through the vertical 15. The gas outlet 16 is the open end of the vertical 15.

Figure 5:
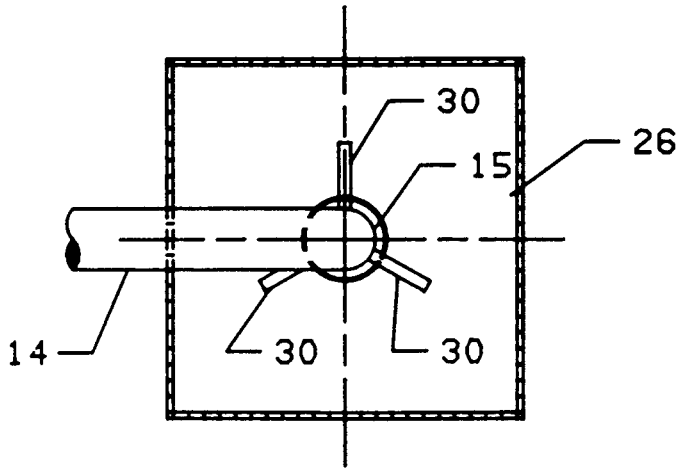
FIG. 5 is a view taken along the line D—D in FIG. 4.
Figure 4:
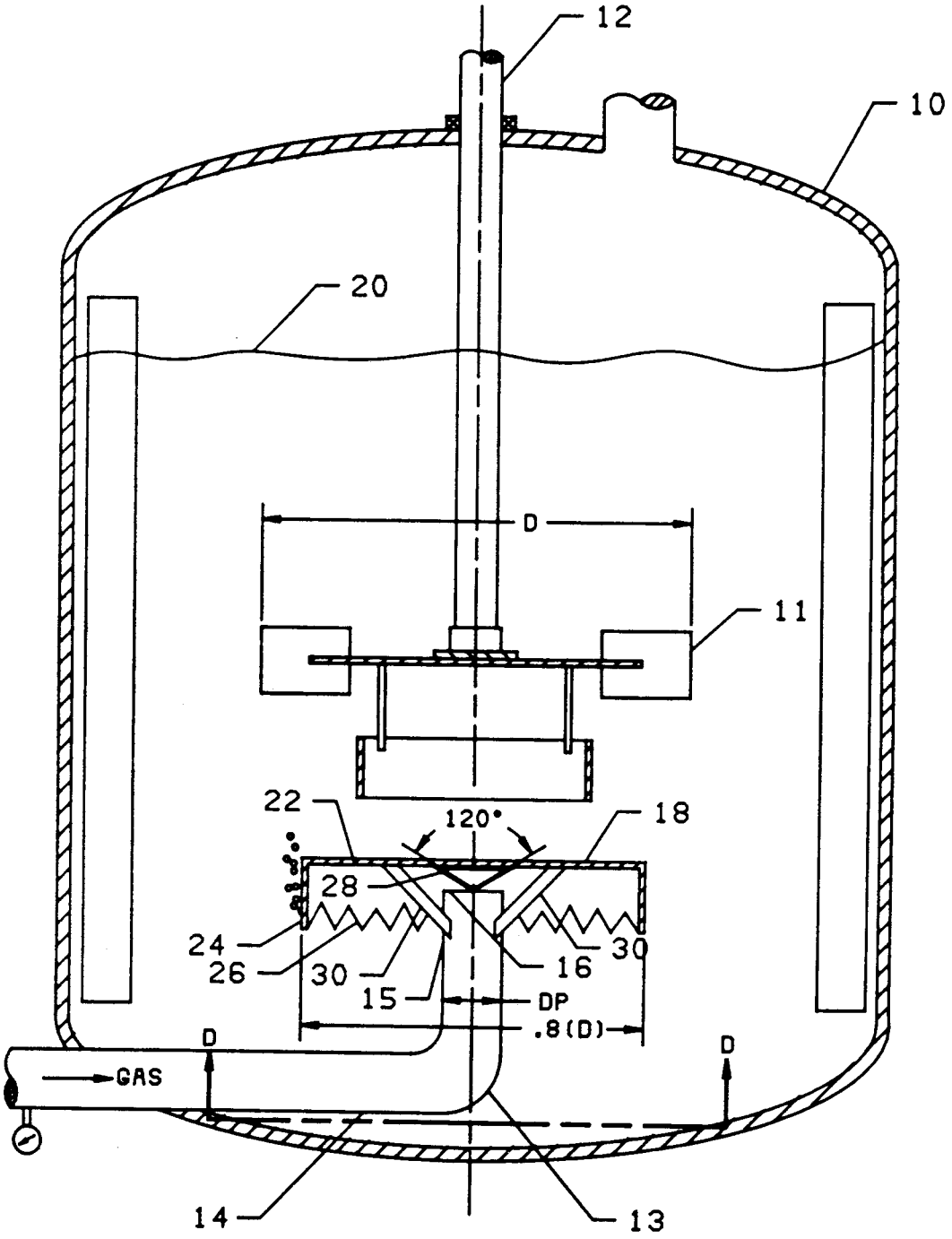
FIG. 4 is a view similar to FIG. 2 of sparging apparatus in accordance with another embodiment of the invention which utilizes a non-symmetric gas distribution cap with a serrated rim of teeth of randomly varying height.

A cover or cap 18 is located between the impeller and the gas outlet. The gas outlet 16 faces the surface 20 of the liquid or slurry in the tank and releases gas along its axis which is along the axis of rotation of said impeller. The cap 18 has, and is closed by, a top plate 22. The top plate 22 is located between the surface 20 and the outlet 16. The cap has a side wall and is annular (a tube or ring) in shape as shown in FIGS. 1 to 3. The cap is preferrably non-symmetric in shape with respect to the outlet 16, as shown in FIGS. 4 and 5. In FIGS. 1-3 the cap forms a cylindrical cup closed at the top and open at the bottom. The bottom rim 26 is preferably serrated with a saw tooth edge.

The serrations are teeth, which as shown in FIG. 4, may vary in height. The variation is preferrably random to enhance the lack of symmetry of the cap with respect to the gas outlet 16; thereby further varying the distribution of radial distance from the gas outlet to the rim of the side wall where the gas bubbles are released. The top of the cap preferably has a turning cone 28. This turning cone has its apex along the shaft axis and aligned with the center of the outlet 16. The cone 28 may be a depression in the cover or a separate cone which is attached to the top of the cap, as shown. There is a gap or spacing between the outlet and the top of the cap which is indicated in FIG. 2 by the arrow labeled gap setting. This setting is sufficient to preclude rapid build up of scale or slime on the inside surfaces of the cap and the pipe outlet which might foul the sparge and reduce gas flow. It is a feature of this invention to enable this gap setting to be large enough to avoid the need for frequent shut down of the system for cleaning. If build-up of material (from the slurry) is not a problem the gap can be smaller. The cap is attached to the vertical 15 by brackets or spiders 30. The top of the outlet is spaced from the rim as measured at the uppermost edge of the serrations. This distance is shown in the drawing by the arrow labeled "overlap setting".

The overlap setting is such that a sufficient volume of gas is trapped within the cover to damp pressure pulsing conditions. It is believed that the volume of gas in combination with the gas trapped inside the cover defines an acoustic filter which damps pressure pulsing conditions when the pressure of the gas is not significantly greater than the hydrostatic pressure of the liquid in the vessel.

FIGS. 4 & 5 show the cap 22 shape as being non-symmetric with respect to the gas outlet 16. In FIGS. 4 & 5 like parts are identified by like reference minerals. Non-symmetric shapes such as square, oval and oblong or triangular (in plan view) may be used. The square shape reduces the fluid forces especially axial forces, acting upon the mixer impeller more than the circular shaped does, and is preferred.

Since the bubbles must travel different distances before being released from under the square cap; the radial distance from the outlet 16 to the rim 24 being greatest at the corners of the square and at a minimum at the center of each side of the square, a pulse of bubbles is spread both spatially and in time while being dispersed. The random height serrations (teeth) also change the path lengths and further spread the bubbles while being dispersed. Dimensions representing an illustrative embodiment of the dimensions in a typical application are shown in the drawings. They are referenced to the diameter of the sparge pipe 14, 15 (DP) which is the diameter of the outlet 16.

From the foregoing description it will be apparent that there has been provided improved apparatus for dispersing or sparging a compressible fluid such as a gas and preferably an oxygen containing gas such as air into a liquid. While a preferred embodiment of the invention and typical illustrative dimensions have been presented, it will be appreciated that variations and modifications within the scope of the invention are possible and that the dimensions will vary depending upon pressure conditions in the vessel and type of impeller used. Also it will be apparent that other sparge devices than pipes, for example sparge rings may be used. Accordingly the foregoing description should be taken as illustrative and not in a limiting sense.

What is claimed is:

1. In a mixing system for dispersing a compressible fluid into liquid or slurry in a vessel and having an impeller for circulating said liquid, the improvement comprising a conduit for supplying said fluid into said vessel, said conduit having an outlet for said fluid, a cover below said impeller and around said outlet and having a side wall with upper and lower ends, said outlet and said side wall being spaced from each other such that the area defined by said side wall is significantly greater than the area defined by said outlet, the upper end of said cover being closed by a top wall, said top wall being disposed between said outlet and the surface of the liquid in said vessel, the lower end having a rim, said outlet being disposed at a distance above said rim so as to confine a sufficient body of said fluid in said cover around said outlet to damp pulsating flow of said fluid when the hydrostatic pressure of the liquid at said outlet is not substantially less than the pressure of said fluid at said outlet, said side wall being provided by an annular wall and, said top wall having an inverted conical surface with its apex end extending downward and facing said outlet.

2. In a mixing system for dispersing a compressible fluid into liquid or slurry in a vessel and having an impeller for circulating said liquid, the improvement comprising a conduit for supplying said fluid into said vessel, said conduit having an outlet for said fluid, a cover below said impeller and around said outlet and having a side wall with upper and lower ends, said outlet and said side wall being spaced from each other such that the area defined by said side wall is significantly greater than the area defined by said outlet, the upper end of said cover being closed by a top wall, said top wall being disposed between said outlet and the surface of the liquid in said vessel, the lower end having a rim, said outlet being disposed at a distance above said rim so as to confine a sufficient body of said fluid in said cover around said outlet to damp pulsating flow of said fluid when the hydrostatic pressure of the liquid at said outlet is not substantially less than the pressure of said fluid at said outlet, said cover being of non-symmetric shape with respect to said outlet, and said non-symmetric shape being provided by said side wall being rectilinear in cross section.

3. The system according to claim 2 wherein said rectilinear cross section is a square.

4. In a mixing system for dispersing a compressible fluid into liquid or slurry in a vessel and having an impeller for circulating said liquid, the improvement comprising a conduit for supplying said fluid into said vessel, said conduit having an outlet for said fluid, a cover below said impeller and around said outlet and having a side wall with upper and lower ends, said outlet and said side wall being spaced from each other such that the area defined by said side wall is significantly greater than the area defined by said outlet, the upper end of said cover being closed by a top wall, said top wall being disposed between said outlet and the surface of the liquid in said vessel, the lower end having a rim, said outlet being disposed at a distance above said rim so as to confine a sufficient body of said fluid in said cover around said outlet to damp pulsating flow of said fluid when the hydrostatic pressure of the liquid at said outlet is not substantially less than the pressure of said fluid at said outlet, said side wall being serrated at said rim, the said distance being the distance between the top of said serrations and said outlet, and said serrated wall being provided by teeth of different height and, said teeth varying randomly in height.

5. Sparging apparatus for use in a mixing system having an impeller rotatable about an axis and an outlet for gas spaced from said impeller which outlet releases gas in a direction along its axis, said improved sparging apparatus comprising a cover around said outlet below said impeller for guiding gas discharged from said outlet, said cover having a non-symmetric shape with respect to said axes outlet, said cover defining an inverted cup over said outlet which has a wall different portions of which are spaced at different distances in radial directions from said outlet, and said wall being square in cross section.

6. Sparging apparatus for use in a mixing system having an impeller rotatable about an axis and an outlet for gas spaced from said impeller which outlet releases gas in a direction along its axis, said improved sparging apparatus comprising a cover around said outlet below said impeller for guiding gas discharged from said outlet, said cover having a non-symmetric shape with respect to said axes outlet, said cover defining an inverted cup over said outlet which has a wall different portions of which are spaced at different distances in radial directions from said outlet, and said wall having a rim which is serrated to define teeth along said rim.

7. The apparatus according to claim 6 wherein said teeth are of different height.

8. The apparatus according to claim 7 wherein the distribution of said teeth along said rim is random.

* * * * *